US005706977A

United States Patent [19]

Ogura et al.

[11] Patent Number: 5,706,977

[45] Date of Patent: Jan. 13, 1998

[54] MODULAR DISPLAY DEVICE

[75] Inventors: Ayami Ogura, Timonium, Md.; Helene F. Paulson, New York, N.Y.; Max E. Syvuk, Sr., Middleburg Heights, Ohio; Brian A. Stanko, New Freedom, Pa.; Stephen N. Hardy, Wadsworth, Ohio; Anthony Calabrese, Cedar Grove, N.J.

[73] Assignee: The Procter & Gamble Company, Cincinnati, Ohio

[21] Appl. No.: 608,015

[22] Filed: Mar. 4, 1996

[51] Int. Cl.[6] ..... B65H 1/00

[52] U.S. Cl. ..... 221/197; 312/42

[58] Field of Search ..... 221/155, 197, 221/123, 92, 131; 212/42, 45

[56] References Cited

U.S. PATENT DOCUMENTS

| | | | |
|---|---|---|---|
| 242,607 | 6/1881 | Cutler | 221/310 |
| 1,477,501 | 12/1923 | Keenan | 312/45 |
| 1,782,597 | 11/1930 | Blackman | 221/124 |
| 2,119,700 | 6/1938 | Burgess | 211/49 |
| 2,360,573 | 10/1944 | Mena | 312/42 |
| 2,487,275 | 11/1949 | Seassau | 35/59 |
| 3,221,930 | 12/1965 | Nasgowitz | 221/92 |
| 3,239,069 | 3/1966 | Hollins | 211/60 |
| 3,298,763 | 1/1967 | Domenico | 312/45 |
| 3,453,056 | 7/1969 | Motsavage et al. | 401/88 |
| 4,099,650 | 7/1978 | Immordino | 221/266 |
| 4,180,192 | 12/1979 | Breslau | 224/235 |
| 4,199,078 | 4/1980 | Ramirez | 221/309 |
| 4,515,290 | 5/1985 | Fishler | 221/124 |
| 4,834,263 | 5/1989 | Becze | 221/197 |
| 4,850,511 | 7/1989 | Knal et al. | 221/197 |
| 5,065,897 | 11/1991 | Smith | 221/131 |
| 5,131,563 | 7/1992 | Yablans | 221/92 |
| 5,294,020 | 3/1994 | Kunz | 221/131 |
| 5,337,897 | 8/1994 | Yablans | 206/581 |
| 5,531,356 | 7/1996 | Baker | 221/281 |

FOREIGN PATENT DOCUMENTS 1386781 3/1964 France .

OTHER PUBLICATIONS

Cover Girl Luminesse, lipstick display device photographs, Figures 1–6.

Revlon Velvet Touch Lipstick, display device photographs, Figures 1–6.

*Primary Examiner*—Kenneth Noland

*Attorney, Agent, or Firm*—Rodney M. Young; Daniel F. Nesbitt; James C. Vago

[57] ABSTRACT

A device for displaying and dispensing articles having a housing and a plurality of removable cartridges is provided. The housing is provided with a cavity for receiving the cartridges such that they can be inserted, removed, and selectively arranged therein. The cartridges have an inlet opening for receiving articles, a hollow chamber for storing articles, and discharge opening for removal of the articles by a user of the display device.

20 Claims, 8 Drawing Sheets

MODULAR DISPLAY DEVICE

TECHNICAL FIELD

This invention relates to a display device for storing and dispensing articles, and more particularly, to an improved display device for the handling, storing and dispensing of cosmetic articles.

BACKGROUND OF THE INVENTION

Several devices for displaying and dispensing articles are known to exist in the art. For example, one such display device can store and dispense articles from a series of fixed chutes or slots which are integrally connected in side by side relation to one another, thus forming a row of fixed slots. Display devices such as these can include several rows of slots. Typically, the articles or items to be dispensed are individually loaded and dispensed from an opening located at the front of each slot. Although in most instances the slots are aligned horizontally side by side, they are generally inclined front to rear so that the individual articles contained within each slot will automatically advance toward the opening one at a time under the force of gravity as each article in front of it is dispensed. This arrangement insures the continual availability of an article at the opening for inspection and/or removal by a user of the display device so long as an article is contained within the slot. Some fixed slot display type devices, instead of being gravity feed, include a spring structure whose spring force assist in the forward advancement of the articles contained within a slot after the forward-most article has been removed.

Another such known device for displaying and dispensing articles has a plurality of columns. However, just like the fixed slot type display devices these columns are fixed in place within a housing such that a series of vertical bins are formed. The housing can be provided with a hanging structure such as hooks, hangers, or the like so that it can be mounted on a store wall, pegboard, shelf, rack, or the like. In such a display device the articles are typically loaded through the top portion of each column and removed from the column at its base or bottom portion. Thus, the articles are generally stacked vertically one on top of the other within each column. After removal of the bottom article, the remaining vertically stacked articles within the column axially translate or index downward under the force of gravity until a new article comes to rest at the base of the column.

Each slot or column of these display devices typically stores a different variation of article (e.g., color, shade, size, flavor, shape, fragrance, etc.). For instance, in the cosmetic industry it is common for cylindrical shaped articles such as lipsticks, mascara, and the like to be dispensed using such display devices. In the case of some cosmetic articles, for example with lipsticks, each slot can be used to store and dispense a particular shade or color of cosmetic article. In order for customers to easily locate or browse for a particular shade, the lipsticks are arranged according to a predetermined color spectrum or planogram having each slot containing a different color with a variation in shade from slot to slot. For example, a typical cosmetic article or lipstick planogram can be a dark red lipstick, adjacent to a red lipstick, next to a light red lipstick, and then a pink lipstick, and so on.

When the merchandising or store personnel desire to introduce an article having a new property (e.g., shade, color, fragrance, texture, etc.) or reset an existing column of articles within the display device, it is often desirable to position the column of articles within a predetermined arrangement relative to the other columns of articles, for example a new lipstick color may be introduced which is desired to be placed between two previously existing lipstick colors within a color or shade spectrum. In order to accomplish this in a fixed column type display device, each and every article in the affected columns must be individually removed one by one from its respective slot or column, and be placed aside in order to remove the articles from the column in the desired location (and in the event of cylindrical articles such as lipsticks, they must be placed aside in a location from which the cylindrical articles will not roll away) and then each article is individually placed one by one into its new position within the display device so that each article occupies its correct position or column (e.g., each properly aligned within a shade or color spectrum) relative to one another this is a time consuming process which the merchandising and store personnel must perform during each reset. This process can also be very frustrating when dealing with small articles, articles that can easily be mislaid, or when having to change or rearrange several columns of articles at the same time.

Typically the above-mentioned fixed column arrangement of a display device can include a pivotally mounted face plate covering or concealing all of the columns of articles. Such a face plate can be swung open exposing the columns of articles so that an inventory of each column can be visually checked by merchandising or store personnel in order to determine if restocking is needed. Generally such display devices can also have a sample article and/or a name plate removably attached to the front of the face plate aligned with its respective column which further identifies the particular type of article contained within the particular column. Thus, when a reset is performed, for example, rearranging or changing the shades or inserting a new color article into an existing planogram, the sample article and name plate must also be individually removed or repositioned and then re-attached to the face plate and any new sample article and name plate must also be attached to the face plate in a position which matches the appropriate column of articles in the display device. When the article is a cosmetic, such as lipstick, a representative color or shade plate, bullet, or factice can be attached in lieu of an actual sample of merchandise. This movement of the samples in addition to the actual movement of columns of articles adds to the time and frustration level of the merchandiser or store personnel involved in resetting the display.

Consequently, it would be desirable to provide an improved display device for cosmetic articles capable of efficiently and conveniently modifying, changing, replacing, shifting or moving columns of articles rather than having to individually move or remove each individual article separately in order to quickly and easily reset an existing predetermined spectrum. The present invention provides these and other benefits, advantages and features as can be seen from the following description.

SUMMARY OF THE INVENTION

A display device for displaying and dispensing articles comprising a housing, a plurality of removable cartridges, and a face plate for interconnecting the cartridges in provided. Each cartridge has an inlet opening for receiving articles, a hollow chamber for storing articles, and a discharge opening for removing articles. The cartridges are preferably of rectangular box-like shape having opposing first and second side panels, a front panel having a front panel top edge and a front panel bottom edge, a back panel opposite the front panel, and opposing top and bottom portions. The hollow chamber is formed by the interconnection of the panels and is in article communication with both the inlet opening and the discharge opening. Preferably, the inlet opening, hollow chamber and discharge opening are in relative vertical alignment with each other such that the articles are stored substantially vertically within the cartridges and such that, when one of the articles is removed from the discharge opening, another one of the articles moves into the discharge opening. More preferably, each cartridge may include a discharge chute which extends through the discharge opening to facilitate removal of articles from the cartridges by a user of the display device.

Each cartridge can also be provided with a platform for displaying a sample article. The platform can be attached adjacent the front panel by a pivot structure. The pivot structure permits rotation of the platform so that the contents of the hollow chamber may be visually inspected through a transparent portion of the cartridge's front panel without necessitating removal of the cartridge from the housing. The rotation of the platform can be limited such that the platform is in a position substantially perpendicular to the front panel.

The housing preferably is parallelepiped in shape having a housing opening and a cavity which is substantially defined by the interconnection of a top wall, a bottom wall, opposing first and second side walls, and a back wall. The cartridges are interchangeably positioned and removably installed within the cavity such that the discharge opening of each cartridge is assessable through the housing opening.

The housing can be provided with a plurality of slots located adjacent the bottom wall edge. Each slot can engage a tab located on the discharge chute of each cartridge such that the cartridge can be interchangeably positioned and removably installed within the cavity. In addition, a projecting structure can be attached to the back wall of each cartridge to further aid in positioning the cartridge within the cavity.

The display device can also include a face plate having an engagement structure for fastening it to the platform of each cartridge and a locking structure for securing it to the housing. When the locking structure of the face plate is disengaged from the housing, the platform of each cartridge interconnected by the face plate can be rotated simultaneously about its respective pivot structure thus permitting visual inspection of the hollow chamber of each cartridge installed within the housing.

BRIEF DESCRIPTION OF THE DRAWINGS

While the specification concludes with claims particularly pointing out and distinctly claiming the present invention, it is believed the invention will be better understood from the following description taken in conjunction with the accompanying drawings in which:

DETAILED DESCRIPTION OF THE INVENTION

Figure 1:
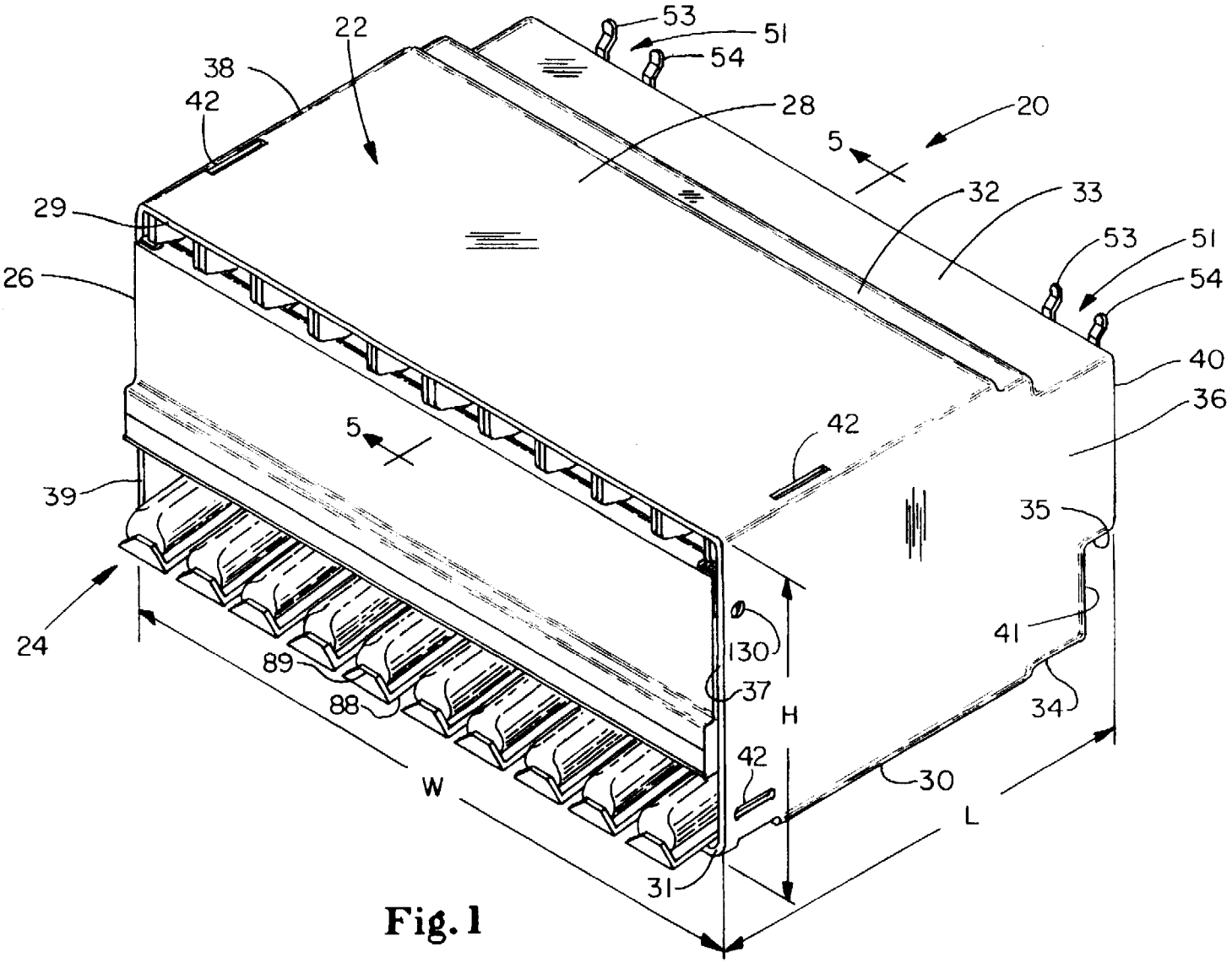
FIG. 1 is a perspective view of a display device made in accordance with a preferred embodiment of the present invention.

Reference will now be made in detail to the presently preferred embodiments of the invention, an example of which is illustrated in the accompanying drawings wherein like numerals indicate the same elements throughout the views. FIG. 1 is a perspective view of a display device, indicated generally as 20, for storing, dispensing and displaying articles made in accordance with the present invention. Display device 20 comprises a housing 22 for interchangeably positioning and removably storing a plurality of modular or removable cartridges 24 which are interconnected by face plate 26. The articles stored, dispensed and displayed in display device 20 are preferably of a regular volumetric shape, for example, spherical, cubic, conic, cylindrical, polyhedral, prismatic, pyramidal, tubular, or the like. More preferably each article is of a generally cylindrical or tubular shape preferably having a diameter that measures from about 1.7 cm to about 2.0 cm and a length that measures from about 6 cm to about 11 cm. Most preferably, each article contains a cosmetic or is a cosmetic article. cosmetic articles typically are items used in beautifying, coloring, enhancing, or the like, of the complexion, skin, hair, nails, lips, face, or the like, and can include, for example, lipstick, lip balm, mascara, lotion, lip color, eye liner, concealer, nail color, and the like. This display device 20 can also be utilized with many other articles of varying shapes and sizes including irregular shaped articles, so long as the articles are capable of being stored and dispensed by cartridge 24.

Preferably, the plurality of cartridges 24 comprises a predetermined number of cartridges 24 from between about 10 and about 12 in number. Display device 20, however, need not contain the entire predetermined number of cartridges 24 at the same time. For instance, if display device 20 contains less than the predetermined number of cartridges or if a gap exists between the cartridges within housing 22, a spacer (not illustrated) can be used to bridge or fill the gap between the cartridges 24 so that any empty space can be filled or the relative alignment and spacing of cartridges 24 within housing 22 can be maintained. Alternatively, the empty space may be left vacant with each cartridge 24 retained in position by the engagement of a cartridge tab with a housing slot, as is described in more detail hereafter.

Housing 22 has a generally parallelepiped shape, and, more preferably, is further stair stepped in shape so that housing 22 may accommodate cartridges 24 of varying shapes and sizes. This parallelpiped shape of housing 22 is most preferably defined by a first top wall 28 having top wall edge 29, first bottom wall 30 having bottom wall edge 31, second top wall 32 adjacent to first top wall 28 and stepped toward first bottom wall 30, third top wall 33 adjacent to second top wall 32 and stepped toward first bottom wall 30, second bottom wall 34 adjacent to first bottom wall 30 and stepped toward first top wall 28, third bottom wall 35 adjacent to second bottom wall 34 and stepped toward first top wall 28, first side wall 36 with first side wall edge 37, second side wall 38 with second side wall edge 39, first back wall 40, and second back wall 41 adjacent to first back wall 40 and stepped toward bottom wall edge 31. In a preferred arrangement, housing 22 has a width W between the first and second side walls 36 and 38 of about 30.5 cm, a height H between the first top wall 28 and first bottom wall 30 of about 21.5 cm, and a length L between first back wall 40 and the bottom wall edge 35 of about 21.6 cm so that housing 22 is interchangeable with existing fixed column cosmetic display boxes. Housing 22 can also he provided with mounting grooves or slots 42 for attaching additional structures to display device 20, such as lipstick tester units or the like. In addition, housing 22 may also include alignment tabs or notches (not illustrated) for aligning and interconnecting adjacent housings 22 mounted on a store wall or rack in order to make up an entire integral store will display. Although housing 22 is described herein as having walls (e.g., first top wall 28, first bottom wall 30, etc) which are dimensionally fixed, it is contemplated that the walls may he adjustable, such as by sliding or ratcheting, so that the length L, height H, or width W of housing 22 may be selectively increased, decreased, or otherwise varied.

Figure 2:
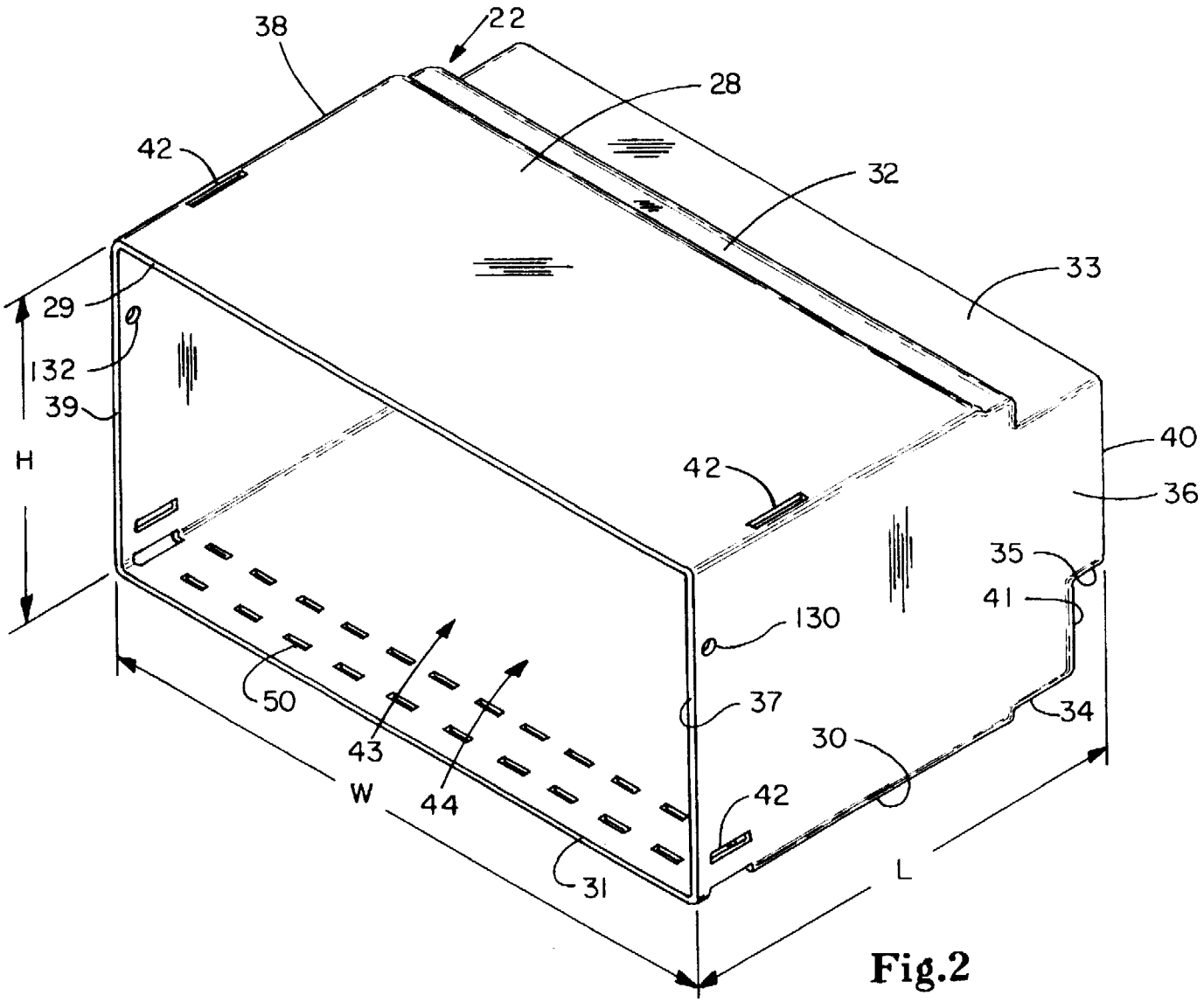
FIG. 2 is a perspective view of a housing of the present invention.

As seen in FIG. 2, housing 22 preferably further comprises housing opening 43 for receiving cartridges 24 and cavity 44 wherein cartridges 24 are removably installed and interchangeably positioned. Housing opening 43 is defined or bounded by the top, bottom and side wall edges 29, 31, 37, and 39, respectively. The top walls, 28, 32, 33; bottom walls, 30, 34, 35; side walls 36 and 38; and back walls 40 and 41 substantially define or enclose cavity 44. Cavity 44 is substantially similar in size and shape to housing opening 43 such that each cartridge 24 installed in cavity 44 can receive and dispense articles, or is otherwise assessable, through housing opening 43. In addition, cavity 44 is sized such that each cartridge 24 can selectively move into and out of cavity 44 through housing opening 43 without substantial interference. The first bottom wall 30 can be provided with at least one, and more preferably two, rows of slots 50 which extend through the bottom wall 30 and are located just inboard of and adjacent to the bottom wall edge 31 for engaging and positioning cartridges 24 within the cavity 44 of the housing 22, as will be described in more detail hereinafter.

Figure 3:
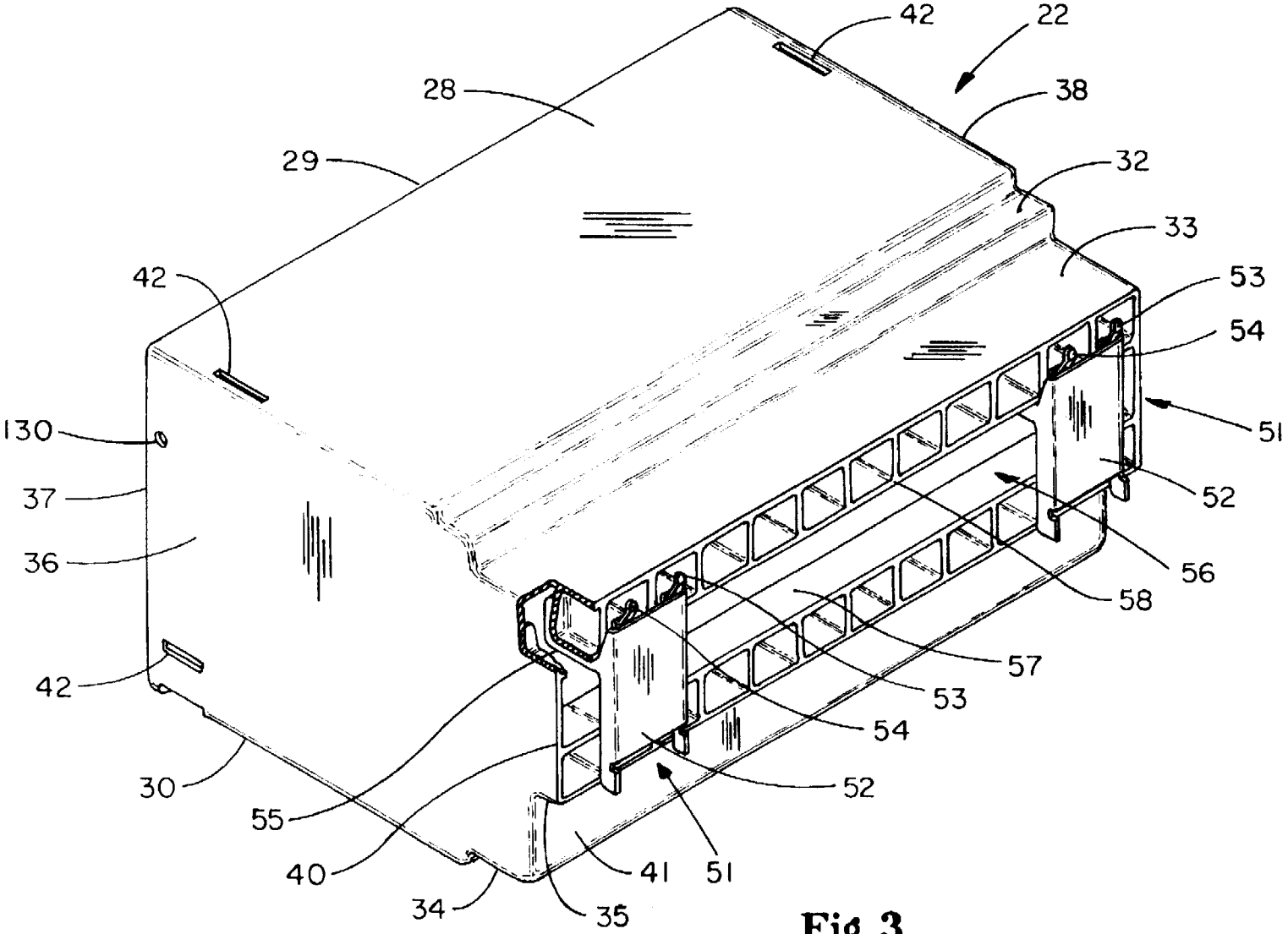
FIG. 3 is a rear perspective view of the display device of the present invention with a portion broken out to show otherwise hidden details.

Although the housing 22 can simply be placed on a shelf or supported by allowing the first bottom wall 30 to rest on the shelf, as best seen in FIG. 3, at least one hanger 51 is provided so that the display device 20 can be mounted on or affixed to a store wall or otherwise anchored to various other fixtures, racks, or supports such as a pegboard. Hanger 51 preferably comprises hanger plat 52 to which are attached hanger prongs 53 and 54 and hanger support arm 55. The hanger 51 can he removably attached adjacent to the first back wall 40 of housing 22 through hanger opening 56, thereby supporting display device 20 when hanger prongs 53 and 54 are inserted into an existing store wall pegboard (not illustrated). Hanger opening 56 is preferably defined or enclosed by first side wall 36, second side wall 38, and opposing first and second hanger opening walls 57 and 58. Alternatively, the hanger 51 can be removably attached to any other wall of the display device 20 in a similar manner as describe with respect to the back wall 40.

Figure 4:
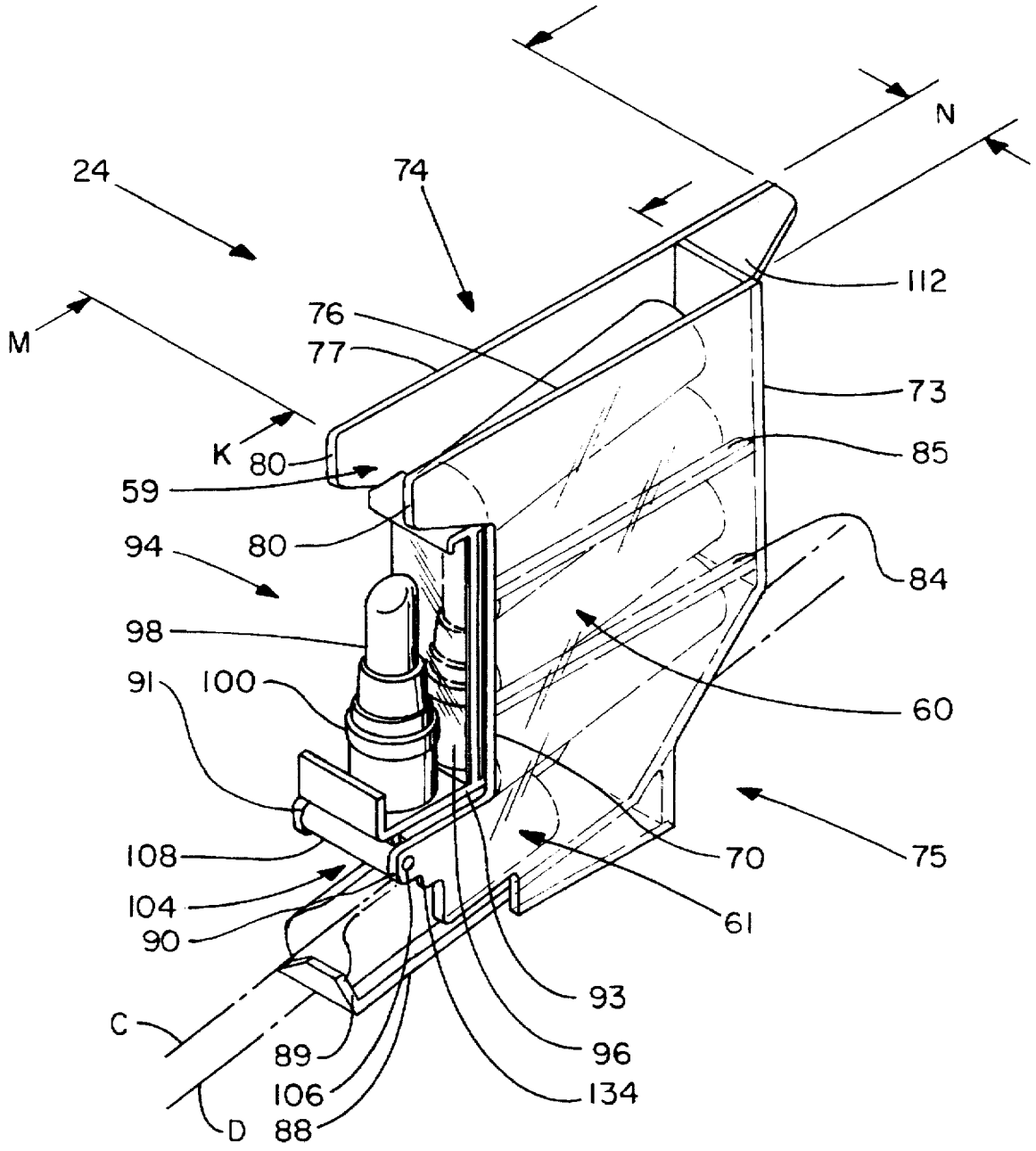
FIG. 4 is a perspective view of a cartridge of the present invention.

Referring now to FIG. 4, cartridge 24 is preferably of generally rectangular box-like shape having an inlet opening 59 for receiving articles, a hollow chamber 60 for storing articles, and a discharge opening 61 for removing articles. More preferable, cartridge 24 has a front panel 70 with a front panel top edge 71 (FIG. 5) and a front panel bottom edge 72 (FIG. 5), back panel 73 opposite the front panel 70, a top portion 74, a bottom portion 75 opposite the top portion 74, and opposing first and second side panels 76 and 77 respectively. The inlet opening 59 extends vertically upward from the front panel top edge 71 and between first and second side panels 76 and 77 so that an article can pass therethrough without substantial interference. Preferably the inlet opening 59 extends vertically upward a distance of from between about 2.5 cm to about 2.9 cm above front panel top edge 71 and more preferably, this distance is slightly greater than the width of the article. Most preferably, inlet opening 59 is further in the form of a slot having a length K extending from side wall front edge 80 to the interior surface of back panel 73 and a width N extending between the interior surface of the first and second side panels 76 and 77. In a most preferred embodiment, length K is preferably from between about 10.6 cm to about 13.5 cm and width N is from between about 1.9 cm to about 2.4 cm so that lipstick articles may be dispensed from cartridge 24. The size and shape of inlet opening 59 can vary from that described herein depending on the size and shape of the articles which cartridge 24 will receive through inlet opening 59. For example, inlet opening 59 can be circular, square, elliptical, triangular, or the like in shape. The inlet opining 59 could also be disposed below front panel top edge 71 rather than above it. For instance, inlet opening 59 may be located on or in front panel 70. Alternatively, the inlet opening 59 can extend wholly along top portion 74 or can even be located in either the first side panel 76 or the second side panel 77. Although, in this preferred embodiment cartridge 24 is provided with an inlet opening 59, articles can be both inserted and dispensed through a single discharge opening 61 and thus the need for a separate inlet opening 59 could be eliminated.

Hollow chamber 60 is utilized to store articles after the articles have been inserted through the inlet opening 59 but before they have been dispensed through the discharge opening 61. The hollow chamber 60 is sized such that a quantity of articles can be stored therein. In a preferred embodiment a quantity of from between about 4 to 8 tubular shaped cosmetic articles stacked vertically in a column can be contained within the hollow chamber 60 at one time.

Hollow chamber 60 is preferably located vertically below and/or adjacent to inlet opening 59 such that it is in article communication with the inlet opening 59. The phrase "article communication," as used herein, shall define a structural relationship wherein articles may move without substantial interference, such as by sliding, indexing, dropping, falling, translating, or the like, between two elements (e.g., as between the inlet opening and the hollow chamber, or between the hollow chamber and the discharge opening). The hollow chamber 60 is defined or substantially enclosed by first and second side panels 76 and 77 and front and back panels 70 and 73. A number of vertically staggered ribs, 84, 85, 86 (FIG. 7), and 87 (FIG. 7) can be provided on the interior surface of first and second side panels 76 and 77 to separate or stagger the articles stored within hollow chamber 60 so that they do not became misaligned and/or bind against the interior surface or each other when translating axially downward within the hollow chamber 60 toward discharge opening 61 under the force of gravity.

Figure 5:
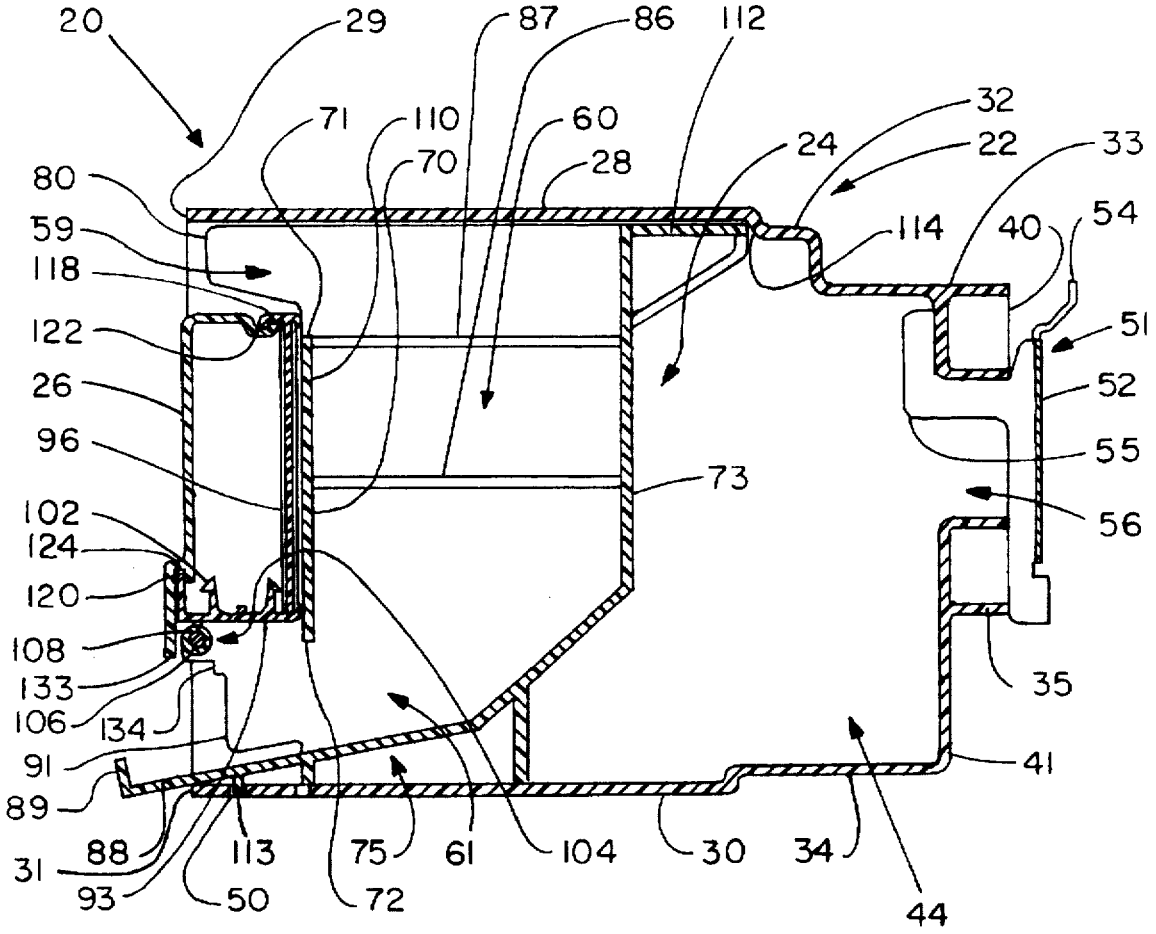
FIG. 5 is a cross sectional view of the display device of FIG. 1, taken along line 5—5 with the articles removed for clarity.

As best seen in FIG. 5, bottom portion 75 preferably comprises a discharge opening 61 and discharge chute 88. Discharge opening 61 is positioned axially below and in article communication with hollow chamber 60 and is bounded by front panel bottom edge 72, discharge chute 88 and first and second side panels 76 and 77. The discharge chute 88 is situated such that an article can automatically index, translate or otherwise move downwardly under the force of gravity from hollow chamber 60 through discharge opening 61 and along discharge chute 88 until it comes to rest against stop 89. Discharge chute 88 is preferably sloped downwardly and more preferably has a downward sloping angle of from between about 10 to about 15 from horizontal in order to facilitate the movement of articles toward stop 89. The opposing first and second guide walls 90 and 91 extend forwardly from the first and second side panels 76 and 77 respectively at the discharge opening 61. These opposing first and second guide walls 90 and 91 are provided adjacent to the discharge chute 88 in order to direct each article within discharge chute 88 toward the stop 89.

The specific configuration of discharge opening 61 and discharge chute 88 can be optimized by arranging the discharge opening 61 differently for articles of varying shapes and sizes without deviation from the scope of the invention disclosed herein. For example, the discharge chute 88 can be positioned at a steeper angle or can even be arranged substantially flat. Alternatively, cartridge 24 can be configured without providing discharge chute 88, so that the articles are dispensed directly from discharge opening 61. When cartridge 24 is used for storing cylindrical shaped type articles, it is preferred that hollow chamber 60 and discharge chute 88 are aligned and in article communication with each other such that the cylindrical articles are axially aligned with discharge chute 88. More preferably, each cylindrical article has a centerline axis C (FIG. 4), the centerline axis C being aligned substantially parallel with the first and second side panels 76 and 77 of the hollow chamber 60. When each cylindrical article is dispensed, it is preferred that the centerline axis C (FIG. 4) of each cylindrical article is substantially aligned with the centerline axis D (FIG. 4) of discharge chute 88. This arrangement maximizes the space each cartridge 24 takes up along width W of housing 22 as opposed to an arrangement where the centerline axis C of each cartridge 24 is aligned substantially perpendicular to the centerline axis D of discharge chute 88.

Although it is preferred that inlet opening 59, hollow chamber 60 and discharge opening 61 are in relative vertical alignment with one another so that articles move downwardly advancing through the cartridge 24 under the force of gravity, it is further contemplated that other arrangements or mechanism can be utilized for moving an article from the inlet opening 59, through the hollow chamber 60 to the discharge opening 61 of the cartridge 24. For example, a spring loaded mechanism can be incorporated whose spring force is used to assist the advancement of successive articles by pushing or pulling the articles toward the discharge opening 61.

Referring again to FIG. 4, a platform 93 having a sample article 94, or fractice, can be situated in front of and/or adjacent to the front panel 70 for displaying the specific shape, color, shade texture, or the like of the articles stored within cartridge 24. More preferably, platform 93 can be attached to the fast and seemed guide walls 90 and 91. The platform 93 preferably has a mirrored wall 96 affixed thereto and situated in front of the front panel 70 and behind the sample article 94 in order to provide for an enhanced display of the sample article 94. When the articles to be dispensed are cosmetics articles and in particular are lipsticks, the sample article 94 preferably comprises a bullet 98 and a sample article holder 100, with the bullet 98 replicating the shape, color, shade, or the like of the specific lipstick contained within the cartridge 24. The bullet 98 is attached to or inserted into the article holder 100 which replicates the lipstick canister and the article holder 100 interchangeably engages holder clip 102 (as seen in FIG. 5) for easy removal and replacement of the sample article 94. Alternatively, sample article 94 can thread, twist, slide, snap, or simply be glued into place on the platform 93. In addition, a descriptive article identification tag can also be attached to platform 93 to further aid a consumer in identifying the particular type of article stored within cartridge 24.

Platform 93 can be attached to the first and second guide walls 90 and 91 by pivot structure 104 comprising pivot pin 106 and pivot sleeve 108. The pivot pin 106, having a smaller outer diameter than the pivot sleeve 108 inner diameter, extends through the pivot sleeve 108 with adequate clearance so that the pivot sleeve 108 rotates on the pivot pin 104. The opposing ends of the pivot pin 106 are attached to the first and second guide walls 90 and 91. Pivot sleeve 108 is affixed to or made integral with the platform 93 and is sized to avoid interference with the first and second guide walls 90 and 91. This pivot structure 104 enables the platform 93 and sample article 94 to be pivotally rotated forwardly by the merchandiser or store personnel thereby exposing front panel 70 so that the contents of hollow chamber 60 can be viewed through the front panel 70 which is preferably transparent or alternatively has a transparent portion 110. Various other mechanisms and hinge type structures, for example, living hinge, pin-less hinge, and the like are well known in the art and can be utilized to form the pivot structure 104 without deviating from the invention disclosed herein. Pivot pin 106 and pivot sleeve 108 are preferably constructed of dissimilar materials so that chatter between the pivot pin 106 and pivot sleeve 108 can be minimized assuring smooth operation of the pivot structure 104.

Each cartridge 24 may be interchangeably positioned and removably installed within cavity 44 by a tab and slot arrangement. A tab 113 (FIG. 5) may be disposed on the under side of the discharge chute 88 for engaging a slot 50 in the first bottom wall 30. The engagement of tab 113 and slot 50 positions each cartridge 24 within housing 22 such that the discharge opening 61 and/or discharge chute 88 is properly positioned in order to dispense articles from housing opening 43. Two or more rows of slots 50 can be provided so that a single housing 22 can accommodate cartridges 24 of various different widths N and lengths M, wherein length M is defined as the distance from side wall leading edge 80 to the back edge of projecting structure 112. This will also allow one configuration of a housing 22 to accommodate a variety of different shapes or sizes of articles. Although the above-described tab and slot arrangement is preferred, due to its ease of manufacturer, simplicity and interchangeability, nevertheless many other arrangements for positioning cartridges 24 within housing 22 can be equally suitable. For example, slot 50 can be located in the discharge chute 88 of cartridge 24 while tab 113 can be located on the interior surface of the bottom wall 34. Alternatively, cartridge 24 can clip or snap into housing 22 or a groove rather than slot 50 can be utilized.

Figure 6:
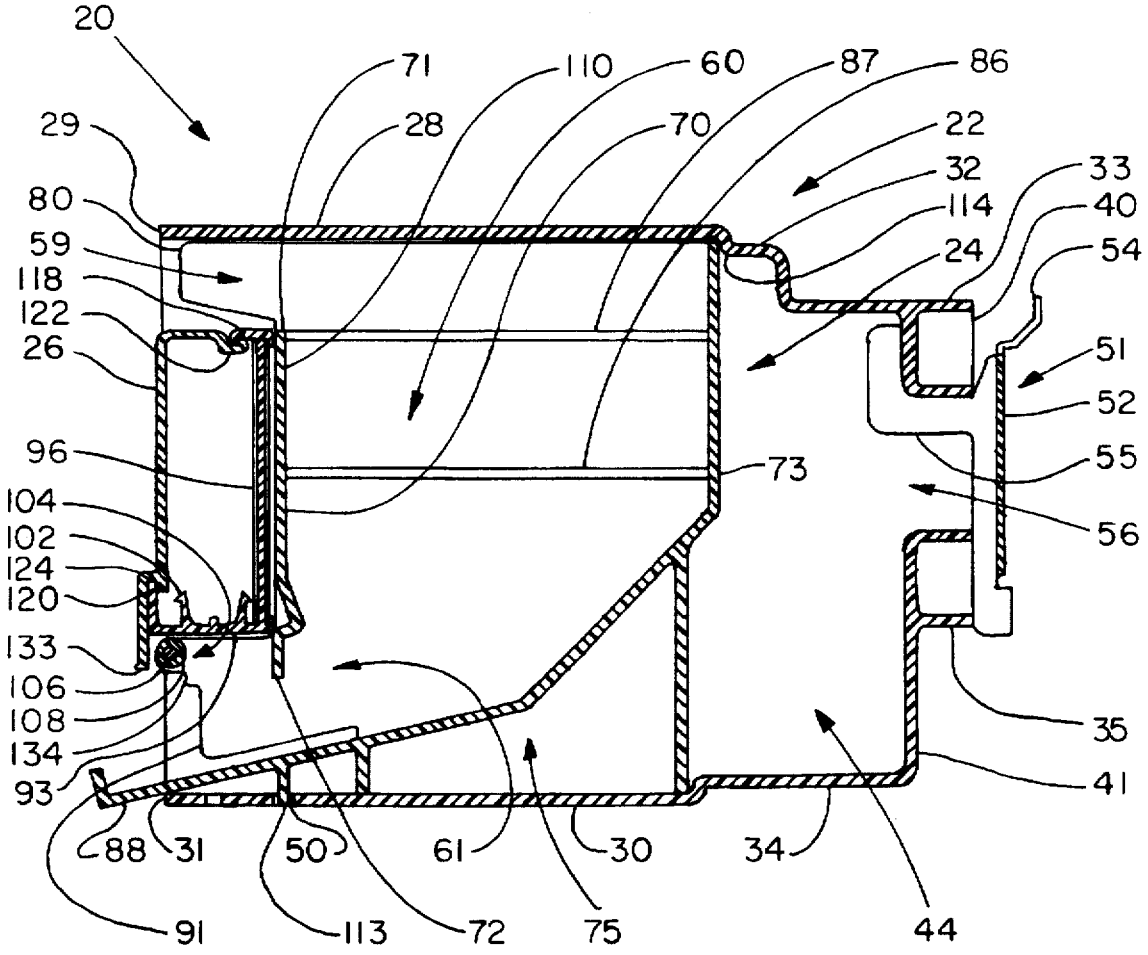
FIG.6 is a cross sectional view similar to FIG. 5, illustrating an alternative embodiment of the cartridge.

As seen in FIG. 5, a projecting structure 112 can also be included to aid in interchangeably positioning cartridge 24 within cavity 44. Projecting structure 112 can be attached to back panel 73, preferably at the upper end of the back panel 73 on the cartridge 24, so that cartridge 24 contacts back face 114 of housing 22 when properly installed within the housing 22. The length of the projecting structure 112 can be varied in order to position the cartridge 24 within the cavity 44 and this projecting structure 112 functions similar to the tab 113 and slot 50 in order to properly position each cartridge 24 within the housing 22. Projecting structure 112 can be omitted if length K of cartridge 24 is such that back panel 73 naturally abuts or contacts the back face 114 when cartridge 24 is positioned within housing 22, as best illustrated in FIG. 6. This arrangement facilitates the use of cartridges 24 having a variety of lengths K in conjunction with the same housing 22 in order to advantageously dispense various sized articles only using one configuration housing 22.

Figure 7:
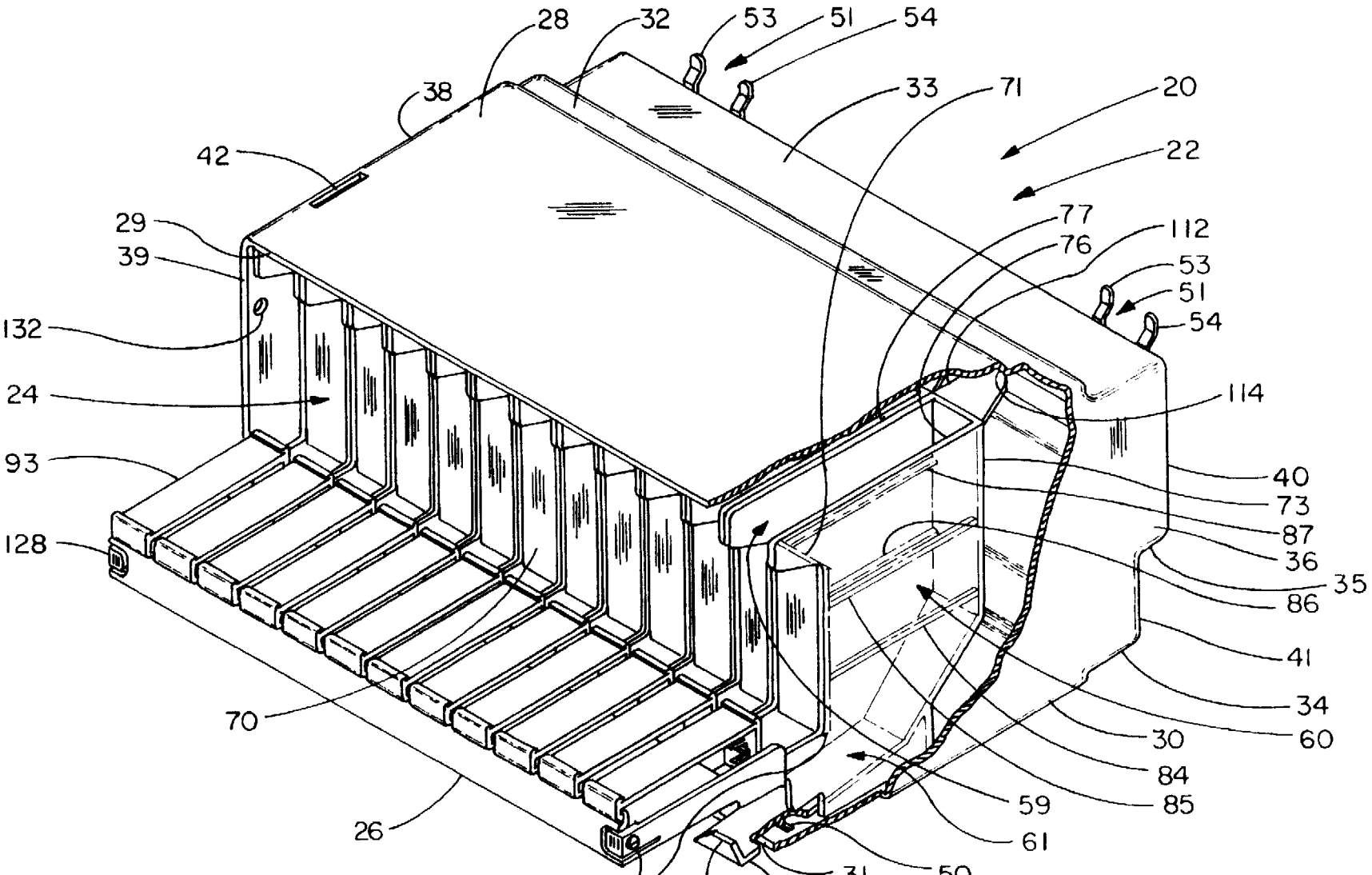
FIG. 7 is a perspective view similar to FIG. 1, having a portion broken out to show otherwise hidden details and depicting the face plate rotated.

In a preferred embodiment, display device 20 can be provided with face plate 26 which functions to join or connect a plurality of platforms 93 together so that all of the platforms 93 can be rotated in unison, as best illustrated in FIG. 7. Use of face plate 26 can be considered optional but, when used, can enable a merchandiser to rotate the plurality of platforms 93 and view the inventory level of articles contained within a plurality of cartridges 24 easily and without having to separately move each platform 93. Face plate 26 is provided with an engagement structure so that it can be attached, fastened, and removed form platforms 93. As seen in FIG. 6, this engagement structure comprises opposing upper and lower grooves 118 and 120 which extend the length of face plate 26 and are located at the upper and lower sides of the face plate 26 respectively. These grooves 118 and 120 mate or engage with opposing upper and lower tongues 122 and 124 respectively so that they form a snap fit with or otherwise engage each other. Face plate 26 can also be provided with a locking structure for securing the face plate 26 to housing 22 in an upright position. This locking structure preferably comprises opposing buttons 126 and 128 mounted on the upper opposing ends of the face plate 26. Bottom 126 and 128 are biased outwardly and engage first and second companion holes or grooves 130 and 132 in the first and second side walls 36 and 38 respectively of the housing 22 such that when the buttons 126 and 128 are depressed they will retract from the first and second companion holes 130 and 132 thereby disengaging the face plate 26 from the housing 22. The fact plate 26, platforms 93, and pivot structures 104 are then free to rotate and can thereby expose the front panel 70 of each cartridge 24, as shown in FIG. 7. Many other locking structures, for example, hooks with loop fasteners or even magnets, can also be suitable for securing face plate 26 to housing 22.

Preferably, rotation of face plate 26 and platforms 93 is stopped or limited by the engagement of face plate lower edge 133 with at least one side wall notch 134 located on side wall 90 and/or 91 and adjacent to a pivot structure 104. More preferably, the engagement of face plate lower edge 133 and a side wall notch 134 is such that platforms 93 are maintained at a position which is substantially perpendicular to the front panel 70 when face plate 26 and platforms 93 have been fury rotated. From this rotated position the merchandiser can rotate the platforms 93 back to their original upright position. Alternatively, a detent can be provided within pivot structures 104 in order to limit the rotation of face plate 26.

The housing 22 and cartridges 24 can be constructed of a substantially rigid material. For example, metals such as steel, aluminum, or metallic alloys; wood; fiberglass; or plastics or the like can be utilized. However in order to reduce cost and allow for ease of manufacture, the housing 22 and cartridge 24 are preferably constructed of styrene or polypropylene, although various other plastics can also be utilized. Housing 22 and cartridge 24 can be formed by injection molding or the housing 22, cartridge 24, and other components can be fabricated of separately constructed or molded parts and each part can be assembled by various forms of plastic welding, adhesives, fasteners, or other forms of mechanical attachment.

In operation the articles are initially installed into the cartridge 24 through inlet opening 59. When a first article 136 (FIG. 8) is removed from discharge chute 88, the articles stored within hollow chamber 60 of a cartridge 24 will axially translate or move downwardly under the force of gravity until a second article 138 comes to rest against stop 89 of discharge chute 88 near the discharge opening 61. If needed the first article 136 can be returned to cartridge 24 through inlet opening 59 whereby it will come to rest within hollow chamber 60 axially above last article 140. The contents of hollow chamber 60 can be visually inspected by first depressing buttons 126 and 128 on each side of face plate 26 so that they are retracted from the first and second companion holes 130 and 132 in the housing 22. Face plate 26 and platforms 93 can then be rotated to a position which exposes transparent portion 110 for viewing of the articles contained within the cartridges 24.

Figure 8:
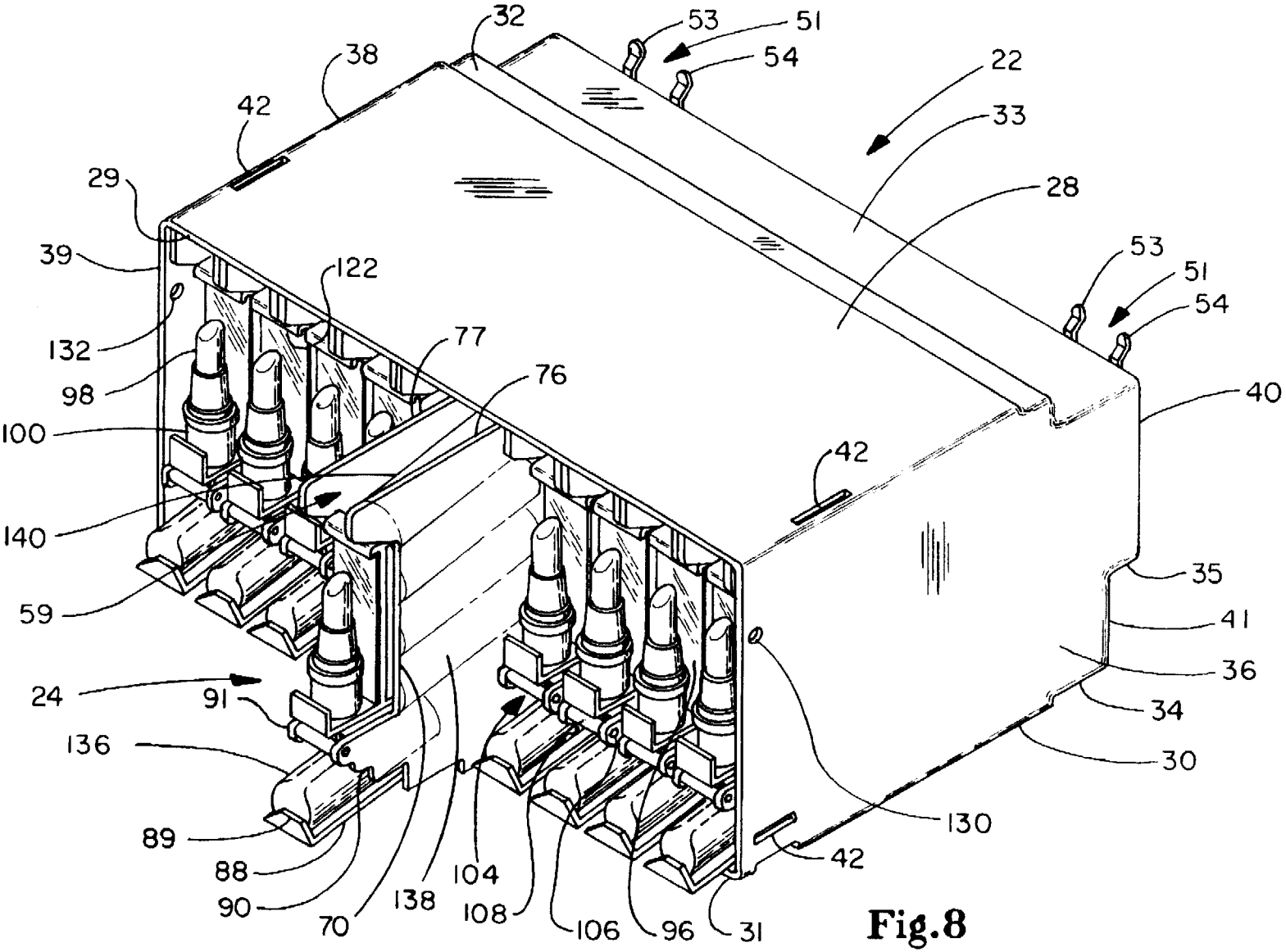
FIG. 8 is a perspective view similar to FIG. 1, with the face plate removed and a cartridge gaily removed.

Rearrangement of cartridges 24 or resetting of a column of articles within the housing 22 is simply achieved by fast removing face plate 26. The face plate 26 is removed by disengaging upper and lower grooves 118 and 120 on the face plate 26 from upper and lower tongues 122 and 124 on each cartridge 24. A single cartridge 24 can be selectively removed from housing 22 by disengaging tab 113 from slot 50 such that it can slide out of housing 22, as best illustrated in FIG. 8. Additional cartridges can be selectively removed by repeating this process or the cartridges 24 can be selectively rearranged by sliding the cartridge 24 transversely within housing 22 after the tab 113 is disengaged from slot 50 such that a new arrangement of cartridges is quickly and efficiently achieved. A new cartridge 24 can be selectively inserted into the cavity 44 of the housing 22 in the space created by rearrangement or removal of the prior cartridge 24. After the cartridge 24 is inserted into the housing 22, the tab 113 of each cartridge 24 can be engaged with a respective slot 50 such that each cartridge 24 is now secured within housing 22. Face plate 26 is reattached to the cartridge 24 by engaging upper and lower grooves 118 and 120 with upper and lower tongues 122 and 124 of each cartridge 24. In this manner, the order in which the columns of articles are displayed can be quickly reset by moving cartridges 24 filled with articles, without removing and restocking each individual article one at a time, thus saving both time and effort.

The foregoing description of preferred embodiments of the invention has been presented for purposes of illustration and description. It is not intended to be exhaustive or to limit the invention to the precise form disclosed. Various modifications are possible in light of the above teachings without deviating from the invention disclosed herein. The embodiments depicted were chosen and described in order to best illustrate the principles of the invention and its practical application and to thereby enable one of ordinary skill in the art suited to the particular use contemplated. For example, while the embodiments shown and described include structure particularly applicable for cosmetic articles, it is contemplated that the invention can be similarly and easily implemented for any of a wide variety of products. It is intended that the scope of the invention be defined by the claims appended hereto.

We claim:

1. A display device for storing and dispensing articles, said display device, comprising:

a plurality of cartridges each one having a hollow chamber for storing a plurality of articles and a discharge opening for removing said articles, said discharge opening being in article communication with said hollow chamber such that when one of said articles is removed from said discharge opening, another one of said articles moves into said discharge opening; and a housing having a housing opening and a cavity therein, said cavity holding said plurality of cartridges such that said discharge opening is accessible through said housing opening, said plurality of cartridges being interchangeably positioned and removably installed within said cavity, and said plurality of cartridges can be selectively rearranged by sliding said cartridge transversely within said housing.

2. The display device of claim 1, wherein said cartridges each further comprise opposing first and second side panels, a front panel having a front panel top edge and a front panel bottom edge, a back panel opposite said front panel, opposing top and bottom portions, said hollow chamber being substantially enclosed by said panels and having a plurality of ribs located on said first and second side panels for staggering said articles within said hollow chamber.

3. The display device of claim 2, wherein said front panel comprises a transparent portion enabling visual inspection of said hollow chamber.

4. The display device of claim 2, wherein said cartridges further comprise a projecting structure located on said back panel for positioning said cartridges within said cavity.

5. The display device of claim 1, wherein said cartridges each further comprise an inlet opening for receiving said articles, said inlet opening being in article communication with said hollow chamber.

6. The display device of claim 5, wherein said inlet opening, said hollow chamber, and said discharge opening are in relative vertical alignment with each other such that said articles are stored substantially vertically within said cartridges and said articles move downwardly under the force of gravity.

7. The display device of claim 1, wherein said housing further comprises a top wall, a bottom wall having a bottom wall edge, opposing first and second side walls, a back wall, said cavity being enclosed by said walls, and said housing having a plurality of slots located adjacent said bottom wall edge for positioning said cartridges within said cavity.

8. A display device for storing and dispensing articles, said display device, comprising:

a plurality of cartridges each one having a hollow chamber for storing a plurality of articles and a discharge opening for removing said articles, said cartridges each further comprise opposing first and second side panels, a front panel having a front panel top edge and a front panel bottom edge, a back panel opposite said front panel, opposing top and bottom portions, said hollow chamber being substantially enclosed by said panels, said bottom portion further comprises a discharge chute which extends through said discharge opening, said discharge chute having a tab for positioning said cartridges within said cavity, said discharge opening being in article communication with said hollow chamber such that when one of said articles is removed from said discharge opening, another one of said articles moves into said discharge opening; and a housing having a housing opening and a cavity therein, said cavity holding said plurality of cartridges such that said discharge opening is accessible through said housing opening, said plurality of cartridges being interchangeably positioned and removably installed within said cavity.

9. The display device of claim 8, wherein said articles further comprise cylindrical shaped articles, said cylindrical articles having a centerline axis, said axis being aligned substantially parallel with said first and second side panels of said hollow chamber.

10. The display device of claim 8, wherein said discharge chute is sloped downwardly and forwardly between about 10 degrees to about 15 degrees.

11. A display device for storing and dispensing articles, said display device, comprising:

a plurality of cartridges each one having a hollow chamber for storing a plurality of articles and a discharge opening for removing said articles, said cartridges each further comprise opposing first and second side panels, a front panel having a front panel top edge and a front panel bottom edge, a back panel opposite said front panel, opposing top and bottom portions, said hollow chamber being substantially enclosed by said panels, said cartridges each further comprise a platform attached adjacent said front panel for displaying a sample article, said discharge opening being in article communication with said hollow chamber such that when one of said articles is removed from said discharge opening, another one of said articles moves into said discharge opening; and a housing having a housing opening and a cavity therein, said cavity holding said plurality of cartridges such that said discharge opening is accessible through said housing opening, said plurality of cartridges being interchangeably positioned and removably installed within said cavity.

12. The display device of claim 11, wherein said display device further comprises a face plate having an engagement structure for fastening said face plate to a plurality of said platforms.

13. A display device for storing and dispensing articles, said display device, comprising:

a plurality of cartridges each having opposing first and second side panels, a front panel having a front panel top edge and a front panel bottom edge, a back panel opposite said front panel, opposing top and bottom portions, a hollow chamber for storing a plurality of articles substantially enclosed by said panels, an inlet opening for receiving said articles, a discharge opening for removing said articles, said inlet opening and said hollow chamber and said discharge opening being in relative vertical alignment with each other such that said articles are stored substantially vertically within said cartridges and such that one of said articles moves into said discharge opening when another one of said articles is removed from said discharge opening, a discharge chute extending through said discharge opening; and a platform attached adjacent said front panel for displaying a sample article;

a housing having a housing opening, a top wall, a bottom wall with a bottom wall edge, opposing first and second side walls, a back wall, and a cavity enclosed by said walls and wherein said cartridges are interchangeably positioned and removably installed;

a tab disposed on said discharge chute and a plurality of slots located adjacent said bottom wall edge such that said slot may engage said tab for interchangeably positioning and removably installing said cartridges within said cavity;

a projecting structure located on said back panel for positioning said cartridges within said cavity; and a face plate having an engagement structure for fastening said face plate to each said platform.

14. The display device of claim 13, wherein said platform further comprises a mirrored wall located between the sample article and the front panel.

15. The display device of claim 13, wherein said cartridges each further comprise a pivot structure for attaching said platform to each of said cartridges.

16. The display device of claim 13, wherein said platform can rotate to a position substantially perpendicular to said front panel.

17. The display device of claim 13, wherein said face plate further comprises a locking structure for securing said face plate to said housing.

18. The display device of claim 13, wherein said engagement structure comprises opposing grooves.

19. The display device of claim 13, wherein said articles are cosmetic articles.

20. The display device of claim 13, wherein said housing further comprises at least one hanger for mounting said display device.

* * * * *